US007232114B2

(12) United States Patent
Platt

(10) Patent No.: US 7,232,114 B2
(45) Date of Patent: Jun. 19, 2007

(54) FENCE ASSEMBLY WITH RAIL CLIP FOR USE THEREWITH

(76) Inventor: Robert E. Platt, 8701 Highland Ave., Mineral Ridge, OH (US) 44440

( * ) Notice: Subject to any disclaimer, the term of this patent is extended or adjusted under 35 U.S.C. 154(b) by 0 days.

(21) Appl. No.: 11/143,850

(22) Filed: Jun. 2, 2005

(65) Prior Publication Data

US 2006/0273296 A1 Dec. 7, 2006

(51) Int. Cl.
*E04H 17/24* (2006.01)

(52) U.S. Cl. ..... 256/65.04; 256/65.11; 256/65.12

(58) Field of Classification Search ..... 256/65, 256/65.01–65.04, 65.08, 66, 68, 19, 59, 70, 256/65.05, 65.06, 65.07, 65.11, 65.12, DIG. 5
See application file for complete search history.

(56) References Cited

U.S. PATENT DOCUMENTS 4,149,701 A * 4/1979 Densen ..... 256/65.03
4,898,365 A * 2/1990 Conner et al. ..... 256/65.12
5,192,056 A * 3/1993 Espinueva ..... 256/65.06
5,238,321 A * 8/1993 Jarjoura ..... 403/172
5,297,886 A * 3/1994 Jansen et al. ..... 403/232.1
5,520,477 A * 5/1996 Fink ..... 403/397
5,560,669 A * 10/1996 Gute ..... 296/97.9
5,617,697 A * 4/1997 Erwin ..... 52/737.4
5,645,270 A * 7/1997 Lawrence ..... 256/66
5,702,090 A * 12/1997 Edgman ..... 256/19
6,203,240 B1 * 3/2001 Hironaka et al. ..... 403/397
6,381,811 B2 * 5/2002 Smith et al. ..... 24/286
6,467,756 B1 * 10/2002 Elsasser ..... 256/65.14
6,499,725 B2 * 12/2002 Meis et al. ..... 256/65.03
6,523,321 B1 * 2/2003 Leek et al. ..... 52/702
6,543,751 B1 * 4/2003 Spruill ..... 256/65.04
6,588,071 B2 * 7/2003 Gramss ..... 24/297

FOREIGN PATENT DOCUMENTS

JP 08184220 A * 7/1996

* cited by examiner

*Primary Examiner*—Daniel P. Stodola
*Assistant Examiner*—Joshua T. Kennedy
(74) *Attorney, Agent, or Firm*—Sand & Sebolt

(57) ABSTRACT

A fence assembly comprising fence posts, fence rails and clips for connecting them together. The fence posts have at least one opening in one or more of the walls and the rail clips are sized to snap fit into the openings. The rail clip includes a rear wall with a pair of aligned side walls extending outwardly away therefrom. A pair of spaced apart flanges extend outwardly away from the outer surface of each side wall and the spaced apart flanges define a slot therebetween. A portion of the wall of the post is received within each slot when the clip is inserted into the opening. The rail is inserted into the clip and then fasteners are employed to secure the clip and rail together and, if desired, to secure the clip to the post.

19 Claims, 6 Drawing Sheets

FENCE ASSEMBLY WITH RAIL CLIP FOR USE THEREWITH

BACKGROUND OF THE INVENTION

1. Technical Field

This invention generally relates to fences. More particularly, the invention relates to a fence assembly that includes a clip for attaching a horizontal fence rail to a vertical fence post. Specifically, the invention relates to a fence assembly that includes a clip that is insertable into an opening in a fence post engaging the wall of the post and the receiving an end of a fence rail therein to connect the rail to the post.

2. Background Information

It has recently become more common to use either vinyl or plastic products for constructing fences for yards, decks and railings on deck staircases. Because of the nature of the materials used, it is fairly difficult to connect the rails to the posts. A number of rail clips have been proposed in the prior art for connecting these components together and the present invention is designed to provide the installer with a quick and easy mechanism for accomplishing this task.

SUMMARY OF THE INVENTION

The fence assembly of the present invention comprises a plurality of fence posts, fence rails and clips for connecting the same together. The fence posts are formed having at least one opening in one or more of the walls. The rail clips are sized to snap fit into the opening in the post wall and the clips include an area into which an end of a rail is received. Once the clip is inserted into the opening in the post, the rail is inserted into the clip and then fasteners are employed to secure the clip and rail together and, if desired, to secure the clip to the post.

The rail clip in accordance with the present invention includes a rear wall and a pair of aligned side walls extend outwardly away therefrom. The distance between the interior surfaces of the side walls is substantially equal to the width of the end of the rail. The distance between the outer surfaces of the side walls is substantially equal to the width of the opening in the wall of the post. A pair of spaced apart flanges extend outwardly away from the outer surface of each side wall and the spaced-apart flanges define a slot therebetween. A portion of the wall of the post is received within each slot when the clip is inserted into the opening. One of the flanges substantially prevents further movement of the clip into the interior of the post and the other of the flanges substantially prevents the withdrawal of the clip from the opening. Fasteners may be used to secure the clip to the wall of the post. The end of the rail is received between the inner surfaces of the side walls of the clip and may be secured therein by way of fasteners.

BRIEF DESCRIPTION OF THE DRAWINGS

The preferred embodiments of the invention, illustrative of the best mode in which applicant has contemplated applying the principles, are set forth in the following description and are shown in the drawings and are particularly and distinctly pointed out and set forth in the appended claims.

DETAILED DESCRIPTION OF THE INVENTION

Figure 1:
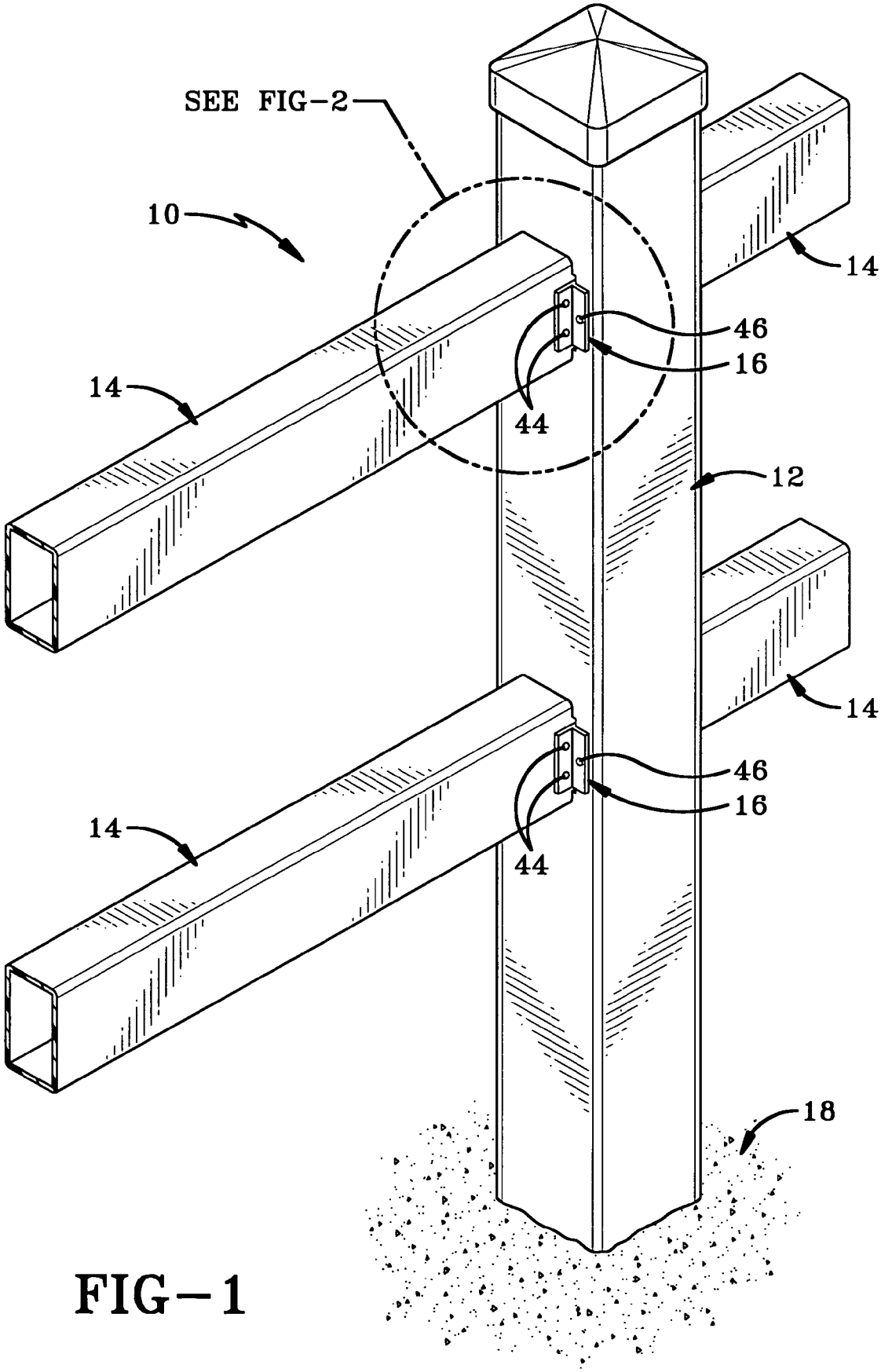
FIG. 1 is a perspective view of a fence post with fence rails attached thereto by way of a fence rail clip in accordance with the present invention.

Referring to FIGS. 1–4, there is shown a fence rail assembly in accordance with the present invention and generally indicated at 10. Assembly 10 includes a plurality of posts 12 and rails 14 together with a plurality of clips 16 to connect posts 12 and rails 14 together. Posts 12 and rails 14 may be manufactured by either extrusion or pultrusion. Each post 12 of fence assembly 10 is installed on a substantially horizontal surface 18 such as the ground, a deck or a stair tread so that it lies substantially vertically with respect to surface 18.

Figure 3:
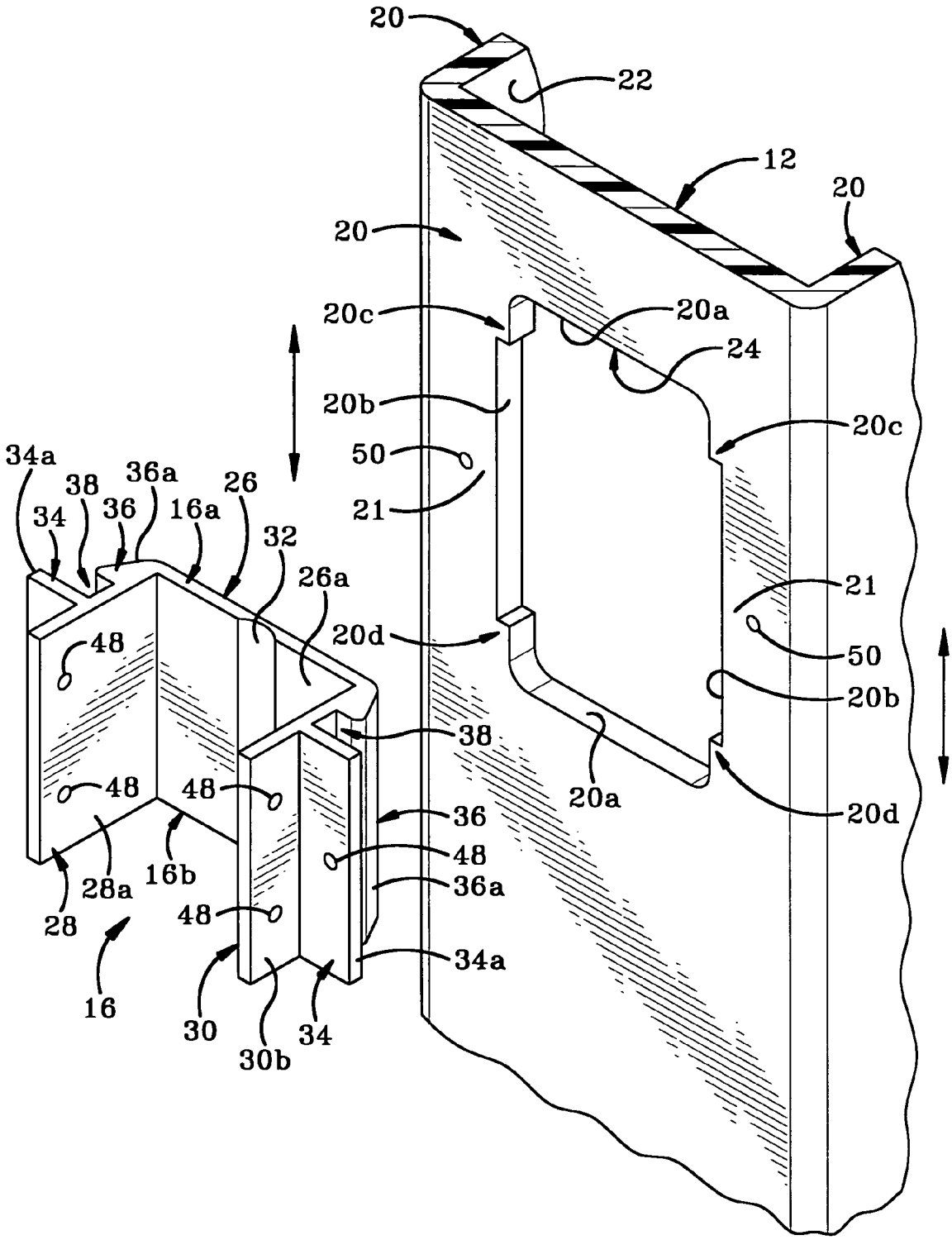
FIG. 3 is an exploded perspective view showing the fence rail clip and a post into which the clip is insertable.

Referring to FIG. 3, it may be seen that each post 12 comprises a plurality of walls 20 that surround an interior cavity 22. At least one of the walls 20 defines at least one opening 24 that is cut into post 12 either on the site or at the factory. Opening 24 is defined by upper and lower ends 20*a* and opposing sides 20*b*, and sides 20*b* preferably are shaped to have a wider section for retaining clip 16 and a narrower section, shown in the regions marked 20*c* and 20*d*, which limit the possible vertical travel of clip 16. The wider section of opening 24 has a vertical height, measured between regions 20*c* and 20*d*, that is greater than the height of the clip 16 it is designed to received.

Figure 4:
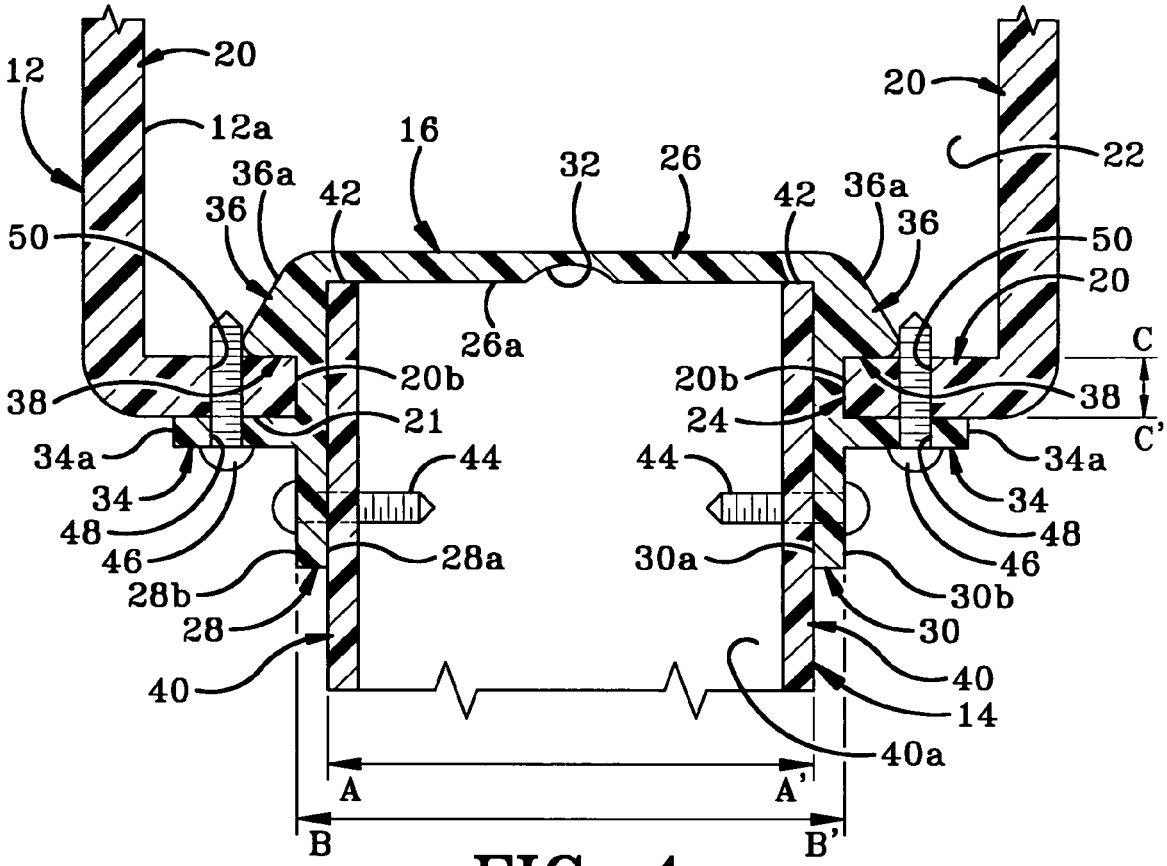
FIG. 4 is a cross-sectional top view of the rail clip connecting the rail to the post.

Clips 16 are designed to snap-fit into openings 24 in posts 12 and are configured to connect rails 14 to posts 12. Clip 16 is molded from plastic or rubber and preferably is integrally formed. Referring to FIGS. 3&4, it may be seen that each clip 16 is generally U-shaped having a rear wall 26 with a pair of aligned side walls 28, 30 extending outwardly away from rear wall 26. Clip 16 has an upper end 16*a* and a lower end 16*b* and the height of clip 16 is measured from upper end 16*a* to lower end 16*b*. As mentioned previously the height of clip 16 is less than the distance between areas 20*c* and 20*d* of opening 24. Rear wall 26 of clip 16 has a substantially planar front surface 26*a* which defines a centrally located groove 32 that runs from top 16*a* to bottom 16*b* of rear wall 26. Rear wall 26 of clip 16 therefore defines a living hinge. Side walls 28, 30 have an inner surface 28*a*, 30*a* and an outer surface 28*b*, 30*b*. The distance A–A' between inner surfaces 28*a* and 30*a* of clip 16 is substantially equal to the width of rail 14 (FIG. 3) to be received therebetween. The distance B–B' between outer surfaces 28*b* and 30*b* of clip 16 is substantially equal to the width of the wider section of opening 24. A first flange 34 extends outwardly away from outer surface 28*a* and 30*a* of each of side walls 28 and 30 and at an angle of between seventy degrees and ninety degrees thereto. First flange 34 lies substantially parallel to rear wall 26 of clip 16. A second flange 36 extends outwardly away from the outer surfaces 28*a*, 30*a* of each respective side wall 28, 30 and proximate rear wall 26. Second flange 36 does not extend outwardly from side walls 28, 30 as far as first flange 34. Second flange 36 lays a spaced distance C–C' away from first flange 34 and a slot 38 is defined therebetween. The width C–C' of slot 38 is substantially equal to the width of the wall 20 of post 12 (FIG. 4). Slots 38 lay substantially parallel to rear wall 26. Second flange 36 further includes an inclined outer wall 36*a* (FIG. 4) which angles outwardly away from rear wall 26 and toward the tip 34*a* of first flange 34. The inclined outer walls 36*a* of second flanges 36 give rear wall 26 beveled ends for easier insertion of clip 16 into opening 24.

Figure 2:
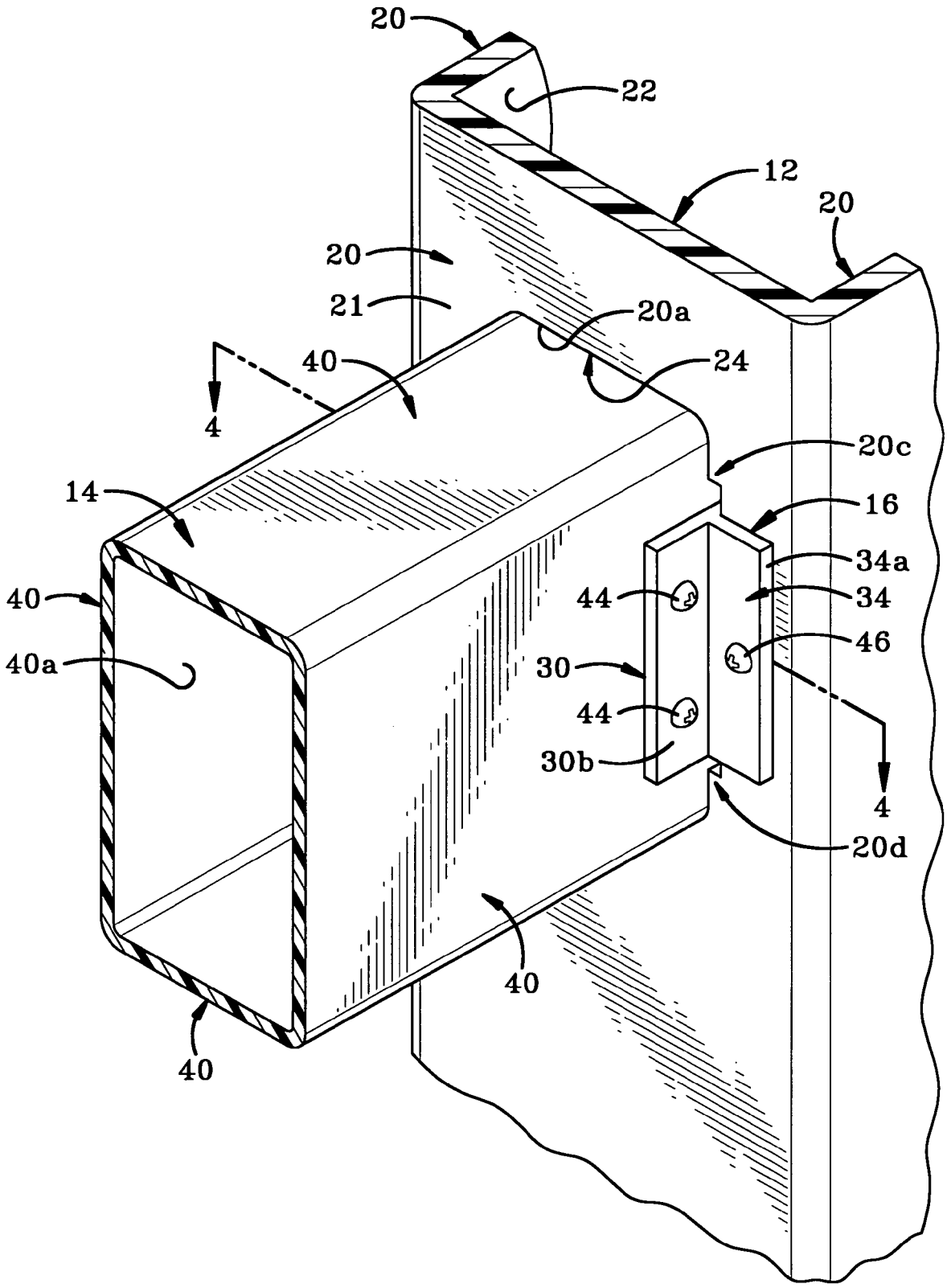
FIG. 2 is an enlarged perspective view of the connection between the fence rail and fence post of FIG. 1.

Rails 14 are elongated members that are constructed from walls 40 and terminate in ends 42. Rails 14 preferably are hollow with the walls 40 defining an internal cavity 40*a* (FIG. 2). The width A–A' (FIG. 4) of each rail 14 is substantially equal to the distance between the inner surfaces 28*a*, 30*a* of clip 16 so that when rail 14 is inserted between side walls 28, 30, it is tightly gripped therebetween.

Fence assembly 10 is used in the following manner. Post 12 is installed into surface 18 so that it lies substantially vertically with respect to surface 18. The installer then inserts a clip 16 into one of the openings 24 in post 12 in the following manner. The installer grasps side walls 28, 30 of clip 16 and brings rear wall 26 into the proximity of opening 24. As rear wall 26 engages wall 20 surrounding opening 24, the installer gently squeezes side walls 28, 30 toward each other. This causes clip 16 to bend around groove 32 and brings inclined outer walls 36*a* of second flanges 36 into contact with sides 20*b* of opening 24. The installer pushes the clip 16 inwardly into interior cavity 22 of post until second flanges 36 clear the wall 20. Portions of wall 20 slide into slots 38 and the first flanges 34 come into contact with outer surface surface 21 of wall 20 (FIG. 2). At this point, a portion of wall 20 lies within slots 38 and any further inward motion of clip 16 is arrested because first flanges 34 extend further outwardly from sides 28, 30 than do second flanges 36. The installer stops squeezing side walls 28, 30 inwardly and may even push outwardly against the inner surfaces 28*a*, 30*a* of side walls 28, 30 so that rear wall 26 is no longer bent around groove 32. At this stage, portions of wall 20 are held within slots 38 in the manner shown in FIG. 4. Second flanges 36 prevent clip 16 from being pulled back out of opening 24 unless side walls 28, 30 are squeezed together again. First flanges 38 prevent clip from being pushed any further into interior cavity 22. Clip 16 is engaged with post 12, but is able to slide up and down wall 20 as indicated by the arrows in FIG. 3 between projections 20*c* and 20*d*. This range of sliding motion allows the installer to select an appropriate position for clip 16.

When clip 16 is properly inserted into opening 24 and wall 20 of post 12 is engaged in slots 38, then the installer slides rail 14 into the gap formed between inner surfaces 28*a*, 30*a* of side walls 28, 30. Rail 14 is slid into the gap until end 42 of rail 14 abuts rear wall 26 of clip 16. Rail 14 is frictionally held between side walls 28, 30 because of the complementary sizing of rail 14 and side walls 28, 30. At this point, the installer preferably uses fasteners 44 inserted through side walls 28, 30 and into wall 40 of rail 14 to lock the components together. The installer may adjust the position of rail 14 relative to post 12 by sliding rail 14 and connected clip 16 vertically up or down within opening 24. When the appropriate position of clip 16 is found, the installer may insert second fasteners 46 through first flanges 34 and into wall 20 of post 12. As shown in FIG. 3, side walls 28, 30 and first flanges 34 may be provided either with holes or areas of weakness 48 for the insertion of fasteners 44, 46. Similarly, wall 20 of post 12 may be provided with holes or areas of weakness 50 for the insertion of fasteners 46. At this point, rail 14 is secured within clip 16 and clip 16 is secured to post 14. The opposite end (not shown) of rail 14 is similarly connected to another clip (not shown) in an adjacent post (not shown) and this process is repeated until the fence is constructed to the desired specifications.

It will be understood that if the installer wishes to remove clip 16 from post 12, all fasteners 44, 46 are removed and rail 14 is slid out of clip 16. He then gently squeezes side walls 28, 30 of clip 16 together so that outer walls 36*a* of second flanges 36 slide along inner surfaces 20*b* of opening 24. At the same time, clip 16 is pulled out of cavity 22 of post 12.

Figure 7:
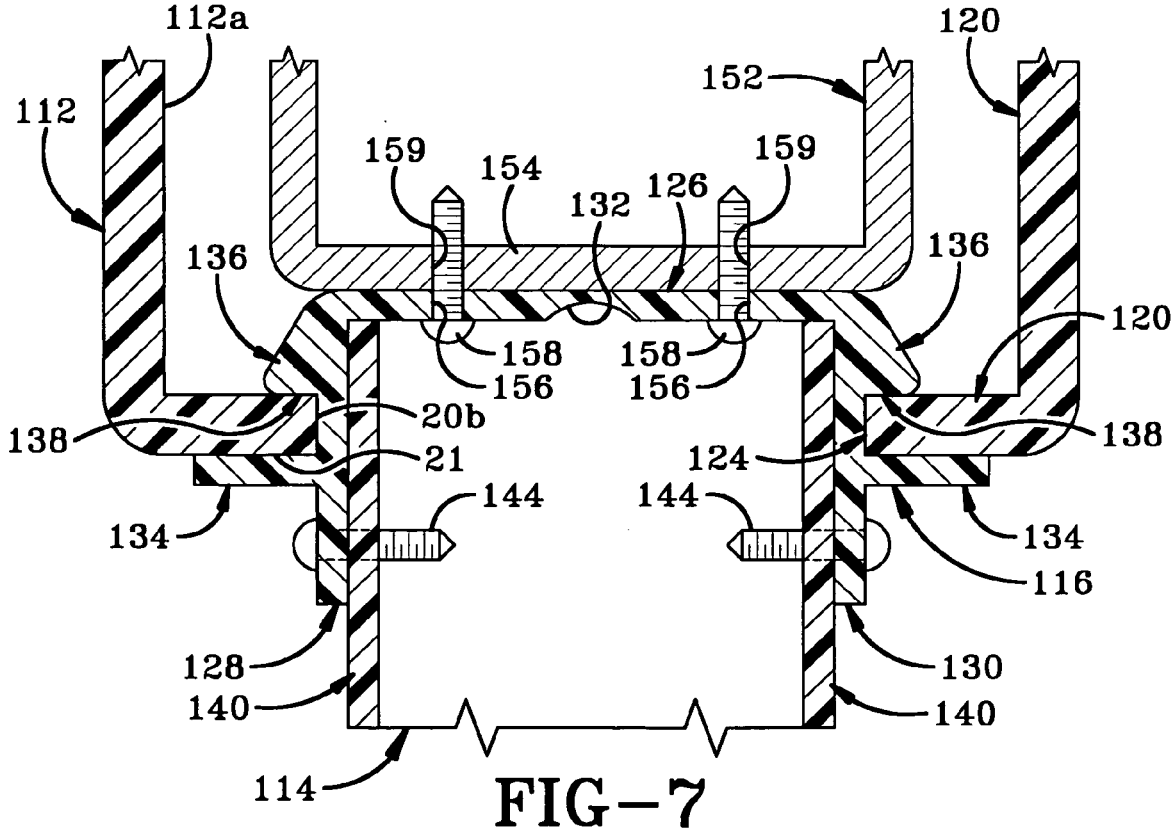
FIG. 7 is a cross-sectional top view of the rail clip connecting the rail to the post and to the metal core.
Figure 5:
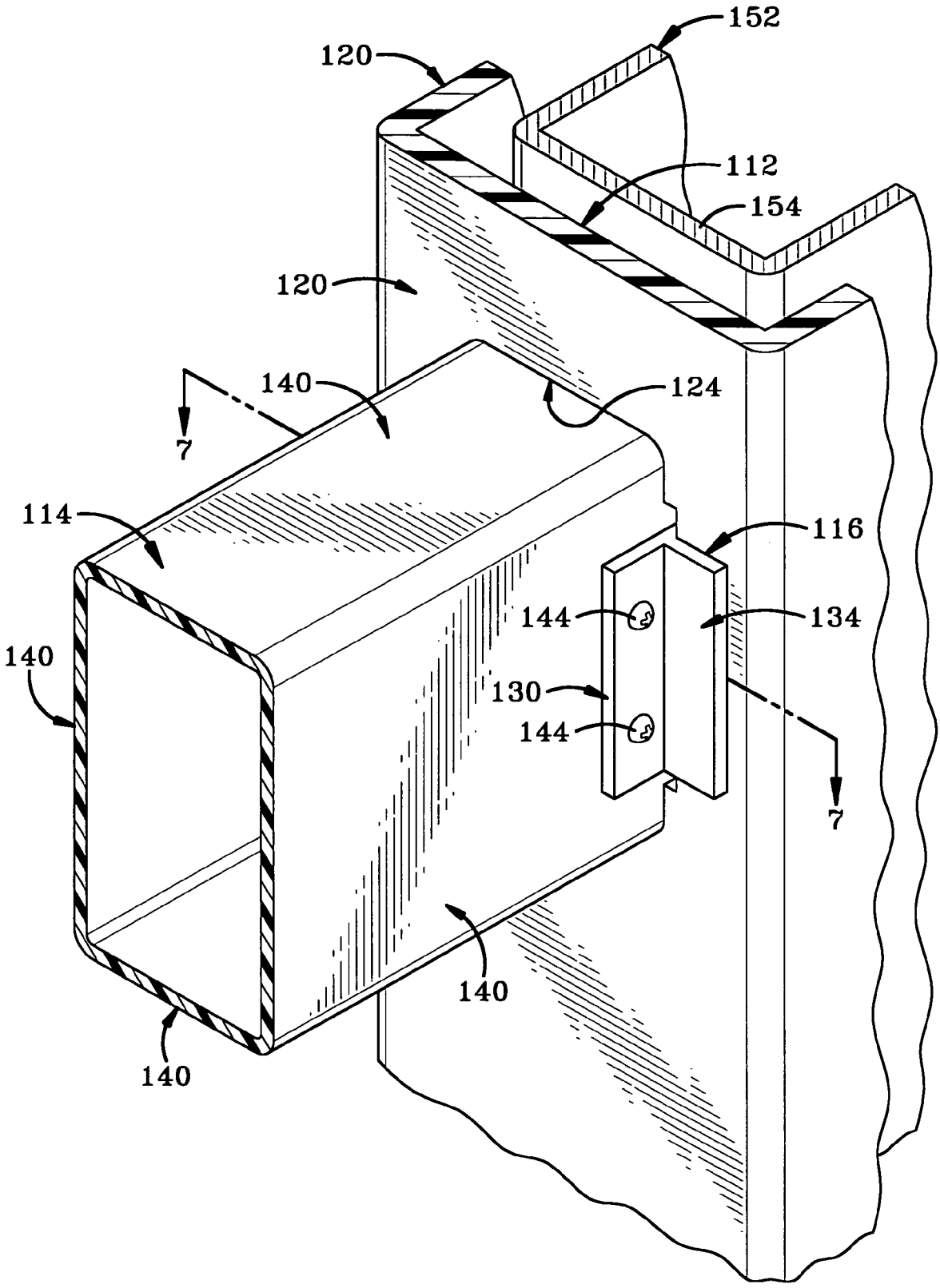
FIG. 5 is a partial perspective view of the fence rail clip connecting a rail to a fence post, which vinyl fence post surrounds a metal core.
Figure 6:
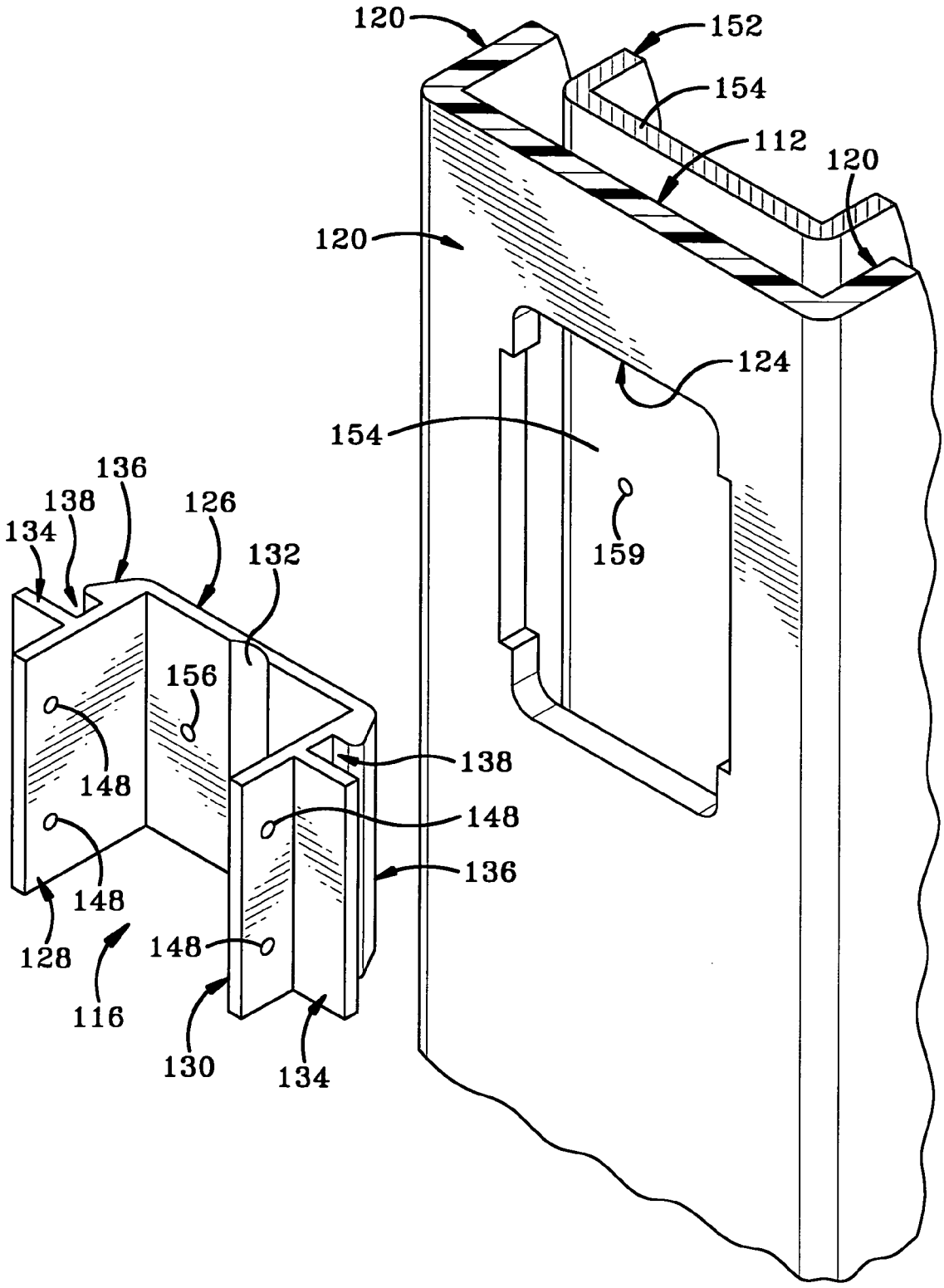
FIG. 6 is an exploded perspective view showing the rail clip, vinyl fence post and metal core prior to assembly thereof.

As is illustrated in FIGS. 5–7, the posts 112 are sometimes installed around a metal core 152 that is made up of side walls 154. In this instance, the installer has the option of using a clip 116 that has holes or areas of weakness 156 in its rear wall 126 in addition to holes or areas of weakness 148 in its side walls 128, 130. Clip 116 is inserted through opening 124 in post 112 in the same manner as clip 16 would be inserted into opening 24. When wall 120 of post 112 is received within slots 138 of clip 116, rear wall 126 of clip abuts side wall 154 of metal core 152. Fasteners 158 may then be inserted through areas of weakness 156 in rear wall 126 of clip 116 and through holes 159 in side wall 154 of metal core 152. Rail 114 is slid between side walls 128, 130 of clip 116. Fasteners 144 are inserted through areas of weakness 148 in side walls 120, 130 and into side walls 140 of rail 114. If desired, the installer can insert additional fasteners (not shown) through first flanges 134 and into wall 120 of post 112. If the installer wishes to remove clip 116 from post 112, he simply unscrews all fasteners 144, 158, squeezes side walls 128, 130 together so that rear wall 126 bends around groove 132 and slides clip 116 out of opening 124.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A fence assembly comprising:

a fence post having at least one wall that defines an opening therein; said fence post including an interior cavity which is accessible through said opening;

an elongated rail having a width, a length and an end;

a clip for securing the rail to the fence post, the clip being engageable in the opening and comprising:

a rear wall;

a first and second side wall originating in the rear wall and extending forwardly away therefrom; each of the first and second side walls having an inner surface and an outer surface and terminating at a front end remote from said rear wall; and wherein said inner surfaces define a gap between them that is sized to receive the end of the rail therein;

a first flange extending outwardly away from the outer surface of each of the first and second side walls a distance rearwardly from the front end thereof, whereby a length of side wall extends between the front end of each of the first and second side walls and a front surface of the associated first flange; and a second flange extending outwardly away from the outer surface of each of the first and second side walls intermediate the associated first flange and the rear wall; whereby a slot is defined between the first and second flanges on each of the first and second side walls and said slots are sized to receive a portion of the fence post wall therein and to thereby secure the clip to the fence post wall; whereby the length of each of the first and second side walls that extends beyond the first flange, projects outwardly away from the fence post wall for a distance.

2. The fence assembly as defined in claim 1, wherein the outer surfaces of the first and second side walls of the clip are spaced a distance apart and the distance between the outer surfaces of the first and second side walls of the clip is substantially equal to the width of the opening in the fence post.

3. The fence assembly as defined in claim 2, wherein the outer surface of each of the first and second side walls engages the post and the inner surface of each of the first and second side walls engages the rail.

4. The fence rail assembly as defined in claim 1, wherein the first flange has an interior surface that engages the front surface of the fence post wall surrounding the opening when the clip is inserted into the opening; and wherein the interior and exterior surfaces of the first flange are substantially parallel to each other.

5. The fence assembly as defined in claim 4, wherein each first flange extends outwardly away from the outer surface of its respective side wall at an angle of between seventy degrees to ninety degrees thereto.

6. The fence assembly as defined in claim 4, wherein the first flanges are disposed substantially parallel to the rear wall of the clip and a spaced distance forwardly away therefrom.

7. The fence assembly as defined in claim 1, wherein each slot has a width and the width of each slot is substantially equal to the thickness of the wall of the fence post.

8. The fence assembly as defined in claim 1, wherein the second flanges extend outwardly away from the outer surfaces of each of the first and second side walls for a shorter distance than do the first flanges.

9. The fence assembly as defined in claim 1, wherein each second flange includes a beveled outer wall that extends outwardly from the rear wall of the clip and terminates at a terminal end of the second flange.

10. The fence assembly as defined in claim 1, wherein the rear wall of the clip further includes a living hinge which allows the first and second side walls to flex inwardly toward each other during insertion of the clip into the opening or removal of the clip from the opening.

11. The fence assembly as defined in claim 1, further comprising a plurality of fasteners; and wherein the fasteners are inserted through the first and second side walls of the clip and into the front end of the rail.

12. The fence assembly as defined in claim 1, further comprising a metal core; and wherein the fence post is disposed over the metal core and the rear wall of the clip abuts the metal core when the clip is inserted through the opening in the fence post.

13. The fence assembly as defined in claim 12, further comprising a plurality of third fasteners, which third fasteners are inserted through the rear wall of the clip and into the metal core.

14. The fence assembly as defined in claim 1, wherein the slots defined by the first and second flanges on each of the first and second side walls are each disposed substantially at right angles to the respective one of the first and second side walls.

15. The fence assembly as defined in claim 1, wherein each of first and second flanges has an inner surface; and the inner surfaces of the first and second flanges on each of the first and second side walls are substantially parallel with each another; and when the clip is engaged in the opening in the fence post wall the inner surfaces of the first flanges abut the front surface of the fence post wall and the inner surfaces of the second flanges abut an interior surface of the fence post wall.

16. The fence assembly as defined in claim 1, wherein each of the first and second side walls has a front end that is disposed a distance away from the rear wall of the first section, and wherein the first flanges are positioned on the respective first and second side walls between the front ends and the second flanges.

17. The fence assembly as defined in claim 1, further comprising a plurality of fasteners that are received through the length of each of the first and second side walls that extends outwardly beyond the exterior surface of each first flange.

18. A fence assembly comprising:

a fence post having at least one wall that defines an opening therein; said fence post including an interior cavity accessible through said opening;

an elongated rail having a width, a length and an end;

a substantially U-shaped clip engageable in the opening in the fence post wall; said clip consisting only of:

a rear wall;

a first and second side wall extending forwardly away from the rear wall and spaced a distance apart so as to receive the end of the rail between them; each of the first and second side walls terminating at a front end remote from the rear wall;

a pair of spaced apart flanges extending outwardly away from an exterior surface of each of the first and second side walls; the flanges of each pair of flanges defining a slot between them that is sized to capture a portion of the fence post wall therein; and wherein a section of each of the first and second side walls extends forwardly between the pair of flanges and the respective front end of the first and second side walls; and at least a pair of fasteners; each fastener being receivable through the section of one of the first and second side walls and into the rail.

19. The fence post assembly as defined in claim 18, wherein the rear wall includes a living hinge that is disposed substantially parallel to the first and second side walls.

* * * * *